United States Patent [19]

Bigelow et al.

[11] Patent Number: 4,506,653

[45] Date of Patent: Mar. 26, 1985

[54] COMBUSTION METHOD AND APPARATUS

[76] Inventors: Lavell M. Bigelow, 3820 Little Rock Dr., Provo, Utah 84604; Robert D. Bigelow, 900 N. 100 W., Pleasant Grove, Utah 84062; William S. Bigelow, 3820 N. Little Rock Dr., Provo, Utah 84604

[21] Appl. No.: 463,642

[22] Filed: Feb. 3, 1983

[51] Int. Cl.[3] ..... F24B 7/00

[52] U.S. Cl. ..... 126/69; 126/4; 126/77

[58] Field of Search ..... 126/4, 5, 3, 126, 137, 126/76, 69, 75, 70, 77, 1 R, 121, 123

[56] References Cited

U.S. PATENT DOCUMENTS

| | | | |
|---|---|---|---|
| 193,621 | 7/1877 | Shelby | 126/3 |
| 838,804 | 1/1907 | Ayers | 126/76 |
| 973,201 | 10/1910 | Jordan | 126/76 |
| 1,044,724 | 11/1912 | Atteberry | 126/76 |
| 1,716,319 | 6/1929 | Miller | 126/76 |
| 1,987,548 | 1/1935 | Brooks | 126/75 |
| 2,461,068 | 2/1949 | Lockwood | 126/76 |
| 3,874,362 | 4/1975 | Kapustin | 126/67 |
| 3,874,364 | 4/1975 | Fauser | 126/121 |
| 4,102,318 | 7/1978 | Runquist | 126/103 |
| 4,194,489 | 3/1980 | Cadwallader | 126/76 |
| 4,368,721 | 1/1983 | Kroupa | 126/4 |
| 4,397,293 | 8/1983 | Pibernat | 126/69 |

FOREIGN PATENT DOCUMENTS

| | | | |
|---|---|---|---|
| 65033 | 6/1939 | Norway | 126/76 |
| 67097 | 12/1941 | Norway | 126/163 R |
| 108985 | 1/1941 | Sweden | 126/76 |

*Primary Examiner*—James C. Yeung

*Attorney, Agent, or Firm*—George H. Mortimer

[57] ABSTRACT

The invention relates to a combustion method and apparatus for carrying out this method.

The method comprises establishing (a) a combustion zone of hot embers above and near a grate and (b) a column of particulate fuel above and resting on said hot embers, supplying combustion air to said combustion zone only, flowing products of combustion generated at the interface between said hot embers and particulate fuel and in said hot embers downwardly through said grate, then upwardly in heat exchange relation to air in a space to be heated, and finally to exhaust.

The apparatus comprises means for holding a column of particulate fuel above a grate, means for flowing air into a combustion zone above and adjacent to said grate at the bottom of said column only, and means for flowing products of combustion downwardly through said grate then upwardly through a heat exchange zone to exhaust.

11 Claims, 13 Drawing Figures

5
14
12
17
11
1
22
21
23
25
24
26
27
5

41
20
19
4
12
17
11
13
27
4

40
18
17
16
12
11

41
17
38
16
14
10
40
10
3
35
30
30
35
4
4
6
5
37
32
2
34
15

41
20
19
14
16
17
18
40
12
39
38
36
30
3
11
31
13
4
21
5
32
32
22
37
25
2
34
24
15

Fig. 6
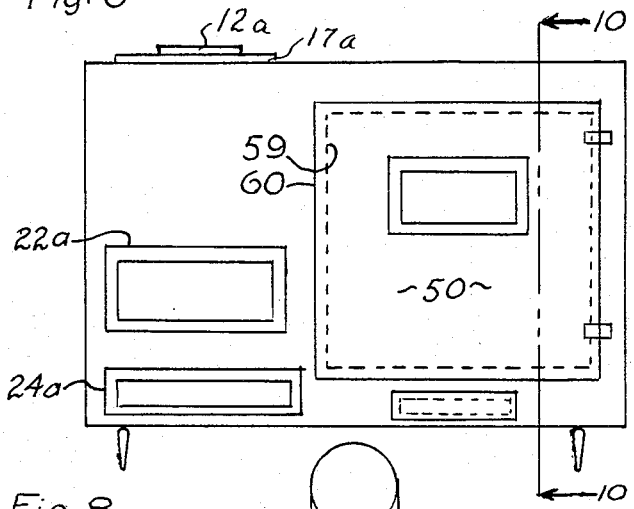
Fig. 7
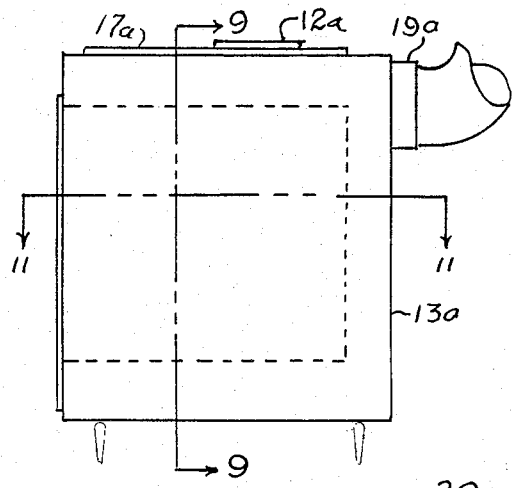
Fig. 8
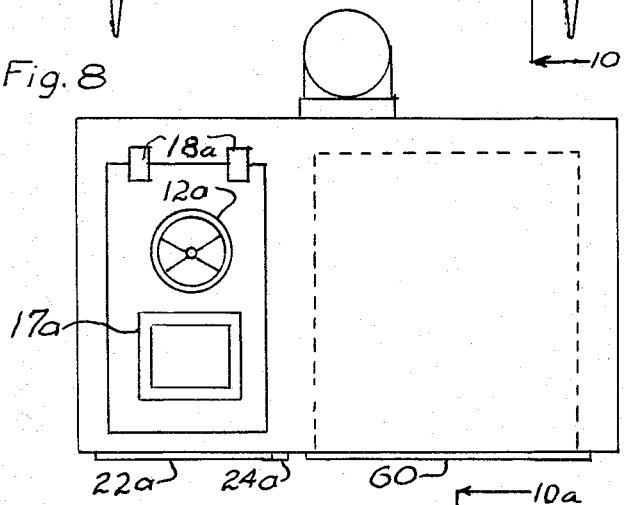
Fig. 10
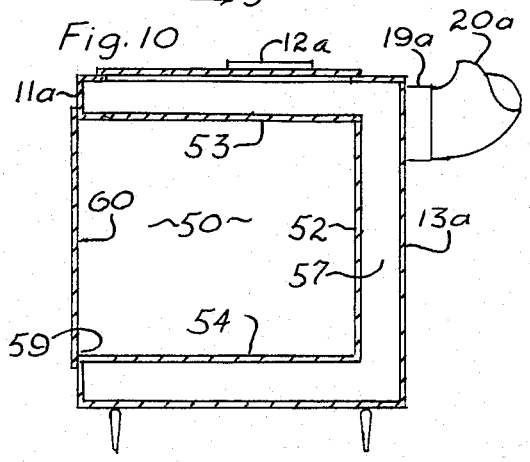
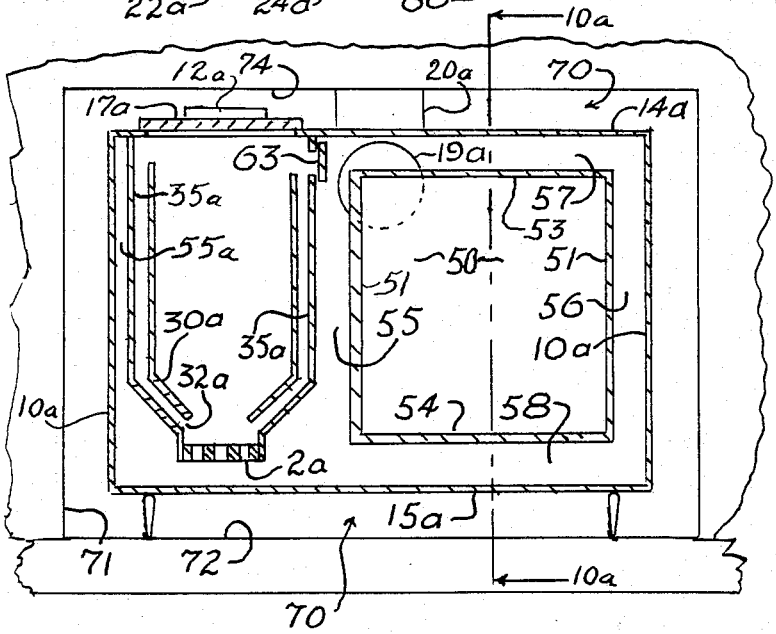
Fig. 9

COMBUSTION METHOD AND APPARATUS

INTRODUCTION

The present invention relates to a combustion method and to apparatus for carrying out the combustion method.

The combustion method involves a new way of flowing air for supporting combustion into and out of a combustion zone which permits a column of particulate combustible material or fuel to be placed above a grate, to confine combustion to a zone adjacent to said grate, and to flow the products of combustion through the grate and a heat exchange zone to a chimney.

The apparatus comprises a grate, means for holding a column of particulate combustible material or fuel above the grate, means for flowing air into a combustion zone only adjacent to and above said grate and means for flowing products of combustion through said grate and a heat exchange zone to a chimney.

BACKGROUND OF THE INVENTION

There are, in general, two ways of flowing air into a combustion zone in a stove or the like.

One of these ways can be called the "up-draft method". In the up-draft method, the air to support combustion is introduced upwardly through a grate on which the combustible material is located which is to be consumed to produce heat. The products of combustion, in the up-draft method, flow from the top of the combustible material upwardly through the stove or other apparatus and into a chimney. This method is relatively inefficient because smoke, which contains much conbustible carbon, and fumes or vapors, which also contain much combustible hydrocarbon material, largely escape unburned from the firebed.

The second general method may be called the "down-draft method". In the down-draft method, air is introduced into the stove or other combustion apparatus above the firebed and flows downwardly through the firebed and the grate to a plenum chamber or other exhaust system to a chimney. In the down-draft method, the products of combustion from the fresher fuel on top of the bed of burning embers passes through the firebed where the combustible part thereof, including smoke and vapors, has an opportunity to burn. The down-draft method is, therefore, generally regarded by those skilled in the art as the more efficient of the two general methods.

Combustion apparatuses are shown in the prior art capable of carrying out each of these methods and combinations of them.

The following patents are referred to by way of example of such prior art:

Ayres U.S. Pat. No. 839,804, patented Jan. 1, 1907, discloses a stove with a grate located approximately one-third of the distance from the bottom to the top of the stove. The space below the grate forms a plenum chamber having a connection to a stove pipe or chimney. The space above the grate also has a connection from the upper portion thereof to the same stovepipe or chimney. There is a damper on the top of the stove leading to an air inlet tube which terminates about halfway between the top of the stove and the grate so that air entering through the damper in the top of the stove is funneled to a sort of jet that impinges upon the fuel resting upon the grate. There is a fuel inlet opening in the top of the stove covered by a hinged door and an ash outlet opening near the bottom of the stove closed by a hinged door which also can serve as an air inlet by means of a valve or damper arrangement in the door. The stove may operate as an updraft stove by closing a damper in the lower connection of the chimney, opening the damper in the ash door, closing the damper in the top of the stove, and opening the damper in the upper connection to the chimney. The stove can also operate as a down draft combustion apparatus by reversing the positions of the four dampers.

Jordan U.S. Pat. No. 973,201, patented Oct. 18, 1910, discloses a heating stove having some similarity to the Ayres stove except that it does not have a damper in the top wall of the stove nor an air inlet tube. On the contrary, the front of the stove is provided with a fuel door in the upper part thereof with a damper in it and two doors near the bottom with dampers in them, the upper door of the two giving access to an ash pit and the lower of them giving access to an air-box. There is a lower outlet from a plenum below the grate comprised of the ash pit and the air-box, and an upper outlet from the space above the grate leading to a common stove pipe which is connected with a chimney or the like. This heating stove can also operate either on the up-draft or down-draft principle by suitable manipulation of the dampers in each outlet and in the three doors mentioned.

Atterberry U.S. Pat. No. 1,044,724, patented Nov. 19, 1912, discloses a stove which operates only on the down-draft principle. The stove comprises a top having air inlet dampers, a fuel inlet opening provided with cover over it, a grate, a plenum chamber and ash pit below the grate with an opening leading into the ash pit which is normally closed by a door having a damper in it. Air is supplied to the space above the grate not only through the dampers in the top of the stove but also through a special conduit which collects air near the floor of the room in which the stove is located, or from any other convenient place, and introduces it high above the bed of fuel burning in the space above the grate.

Brooks U.S. Pat. No. 1,987,548, issued Jan. 8, 1935, discloses a heater which also can work on the up-draft or down-draft principle. The preferred operation is by the down-draft principle with the products of combustion flowing downwardly through the grate and into a manifold or plenum chamber at the bottom of the stove which is connected to a plurality of vertical tubes located at the sides and back of the stove. These tubes, which communicate at their upper ends with a plenum chamber connected to a chimney collar, are spaced from the stove body far enough to permit air circulation completely around them and thereby increase the heat transfer surface for the heat conducted from the products of combustion through the walls of the tubes to the surrounding atmosphere.

Kapustion U.S. Pat. No. 3,874,362, issued Apr. 1, 1975, discloses a space heating device for burning solid fuel which operates on the up-draft principle but has alternate outlets for products of combustion.

Runquist U.S. Pat. No. 4,102,318, discloses a combustion furnace which operates on the down-draft principle with a special reactor chamber below the grate which is intended to assure complete combustion of the products of combustion. This includes a small opening in each sidewall of the furnace at the level of the reactor chamber below the grate so that a small amount of fresh air is introduced laterally into the reactor chamber where only gases are present. The top of the furnace has a hinged airtight lid for introduction of the solid fuel into the chamber above the grate which is called the primary combustion chamber. The front of the furnace has a hinged door also opening into the primary combustion chamber which can be opened for starting the fire. It is provided with a dampered opening for the introduction of air from the room into the primary combustion chamber through which it flows in downward direction through the grate and the reactor chamber and then out a heat exchange chamber near the back of the stove and into the chimney. Back of the heat exchange chamber is an air heating chamber into which air enters at the bottom from the room or outside of the room, flows upwardly through the heating chamber and out into the room. This air is not exposed at any time to products of combustion but only to the heated wall of the heat exchange chamber behind the firebox and in front of the heating chamber for the room air.

All of these combustion devices of the prior art suffer from a number of disadvantages. One is that they require continual attention to adjust dampers for controlling the heat output and for supplying fuel in relatively limited quantities to the combustion chamber or firebox. Loading these stoves with a relatively large quantity of fuel to burn over a much longer period of time is not considered practical because after loading the fuel into the combustion apparatus it either (a) soon all ignites and burns, producing more heat than necessary or (b) snuffs out the fire as is most often the case with small particulate fuel because it blocks off the passage of enough air to support combustion, either by updraft or downdraft operation, and thus burns quite inefficiently with large output of smoke and combustible vapors which escape unburned into the chimney.

SUMMARY OF THE INVENTION

The invention overcomes the disadvantages of the prior art and provides both a new method and a new apparatus for consuming particulate combustible material or fuel. A significant advantage is that a column containing a large quantity of fuel can be established with combustion confined to a shallow combustion zone at the bottom part of the column of fuel by introducing the air for supporting combustion only in this relatively shallow combustion zone adjacent to but above the grate.

Many embodiments of apparatus capable of carrying out this new method are possible and practical and three such embodiments are disclosed herein, including the best embodiment of which applicant is aware.

BRIEF DESCRIPTION OF THE VIEWS OF THE DRAWING

The invention will be described and illustrated in connection with the drawings in which:

FIG. 6 is a front view of another embodiment of the invention;

FIG. 7 is a sideview of the embodiment of FIG. 6;

FIG. 8 is a top view of the embodiment of FIG. 6;

FIG. 9 is a vertical sectional view along the line 9—9 of FIG. 7;

FIG. 10 is a vertical sectional view on the line 10—10 of FIG. 6;

DETAILED DESCRIPTION OF PREFERRED EMBODIMENTS OF THE INVENTION

Figure 1:
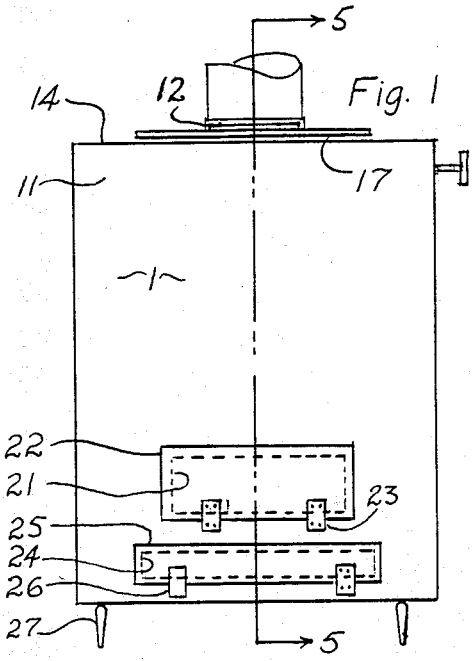
FIG. 1 is a front view of an embodiment of the invention.
Figure 2:
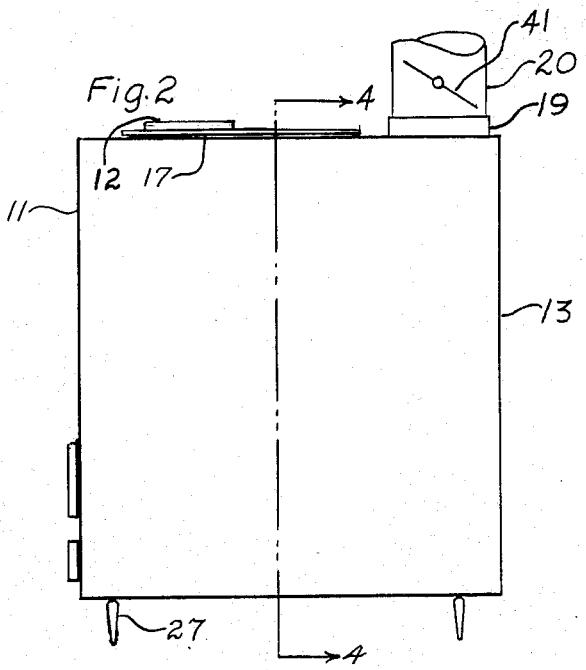
FIG. 2 is a sideview of the embodiment of FIG. 1.

The method of the invention relates to an entirely new principle of combustion of particulate fuel. It is characterized by establishing within a chamber having top, bottom, front, back and side walls a column of particulate fuel above a grate which burns only at the bottom of the column in a combustion zone of limited height adjacent to and above a grate. The column is surrounded at the back and side surfaces by impervious and non-combustible walls, such as steel, above the burning zone. These walls are spaced inwardly from the back and side walls of said chamber to provide an air passageway. Air to support combustion is supplied only into the burning zone at the bottom of the column. The products of combustion are withdrawn downwardly through the burning embers and the grate into a plenum chamber from which these products are flowed upwardly through a heat exchange passageway to a chimney without passing upwardly through the column of particulate fuel. The flow of air from the atmosphere into the air passageway, the combustion zone, the plenum chamber and the heat exchange passageway is caused by pressure differential.

Three embodiments of apparatus for carrying out the method are specifically disclosed herein, which represent the best embodiments of the invention of which applicant is presently aware. All of these embodiments are characterized by comprising a chamber having front, top, bottom, back and side walls, a grate mounted within said chamber above the bottom wall to form a plenum chamber between them, and fuel holding means for holding a column of particulate fuel above the grate comprising back and side walls made of impervious and non-combustible material, such as steel. The front edge of each of these side walls engage the front wall of the chamber while the space between the side and back walls of the fuel holding means and the side and back walls of said chamber constitute an air passageway for air to flow down from a supply such as the atmosphere to the entrance into the combustion zone to be described. The described structure also provides pressure differential producing means for flowing air into the fuel holding means only at the bottom thereof to establish a combustion zone of limited height at the bottom of the column of particulate fuel and means to withdraw products of combustion through and from the combustion zone only downwardly through the grate into a plenum chamber and then upwardly through a heat exchange zone adjacent to said passageway to a chimney without passing upwardly through the fuel holding means.

Referring to FIGS. 1, 2, 3, 4 and 5, which illustrate an embodiment of the invention in the form of a free-standing stove 1, the combustion apparatus comprises a grate 2 suitably supported as hereinafter described, means 3 for holding a column of particulate combustible material or fuel, means 4 for flowing air only into a combustion zone 5 adjacent to and above the grate and means 6 for flowing products of combustion through the combustion zone and said grate into a plenum chamber 34 then through a heat exchange zone to a chimney.

The stove 1 has sidewalls which may have any desired shape in cross-section, e.g., rectangular, cylindrical, and the like. The embodiment shown in FIGS. 1 to 5, inclusive, is rectangular in cross-section and comprises rectangular walls including sidewalls 10, a front wall 11, rearwall 13, top wall 14, and bottom wall 15 of heat conducting and radiating material, such a steel.

The top wall 14 is provided with an opening 16, through which fuel and atmospheric air may be introduced, which is normally closed by a door 17 connected to the top wall by hinge means 18 and, if desired, the door may be made practically airtight by providing gasket material (not shown) around the periphery of the door 17 and/or the periphery of the opening 16. Door 17 is provided with air vents or inlets and a damper 12 to control air flow into the apparatus. The top wall is also provided with a stove pipe fitting 19 over which a length of stove pipe 20 may be telescoped to serve as a chimney or as a conduit to a chimney (not shown).

The front wall 11 of the stove 1 is provided with an opening 21, the bottom of which is about on the level of the grate and which extends across a major portion of the width of the wall. Hinged to the front wall along the lower periphery of the opening 21 is a firebox door 22 provided with suitable hinge means 23 connected to the door and the front wall. It may also be made essentially airtight is the same manner described for the door 17. The front wall is also provided along the lower edge thereof with an opening 24 giving access to the space below the grate in which ashes accumulate as they fall through the grate. Opening 24 is provided with a door 25, which may be called the ash door, and it is provided with suitable hinge means 26 pivotly connecting it to the front wall. Door 25 is preferably made essentially airtight by providing gasket material (not shown) between it and the periphery of the opening 24 in the manner described above for door 17. The stove may be supported on a plurality of legs 27 to provide an air barrier between the bottom wall of the stove and the floor on which it is supported.

The grate 2 may be of any desired construction, e.g., a foraminous casting, a foraminous stamping, a foraminous element made of bars connected to end supports such as angle iron, and the like. The particular structure of the grate is not a part of the present invention and any grates of known or after discovered types may be used in the combustion apparatus of the invention.

Figure 4:
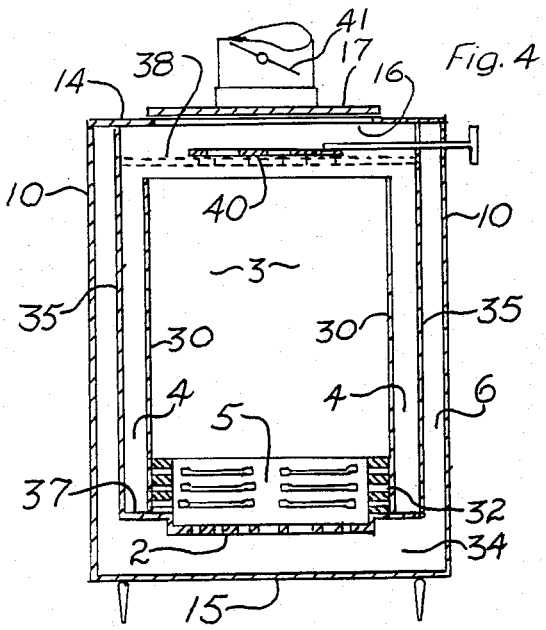
FIG. 4 is a vertical sectional view on the line 4—4 of FIG. 2.

The means 3 for holding a column of particulate fuel comprises sidewalls 30 which are connected at the front edge thereof to the front wall 11 of the stove along lines spaced inwardly a considerable distance from the sidewalls 10 as shown best in FIG. 4 and a back wall 31 connecting the back edges of sidewalls 30. These walls are made of impervious and non-combustible material, such as steel. The upper edge of the side and back walls 30, 31, respectively, is preferably a considerable distance below the top wall 14 as seen in FIGS. 4 and 5.

The lower part of the side and back walls has foraminous means 32 to permit air to flow from an air supply to be described hereinafter into the interior of means 3 to form the combustion zone 5 of relatively shallow height adjacent to and above the grate, as clearly indicated in FIGS. 4 and 5. This foraminous portion of the side and back walls is the only means for flowing air into the combustion apparatus when it is in operation and means 3 is full of particulate fuel. This foraminous material 32 may be perforated firebrick which line the combustion zone 5 on the back and two sides and, if desired, similar material may be provided along the front wall also but this is generally not necessary or desirable. When the apparatus is in operation and the entire means 3 is full of particulate combustible material, air is flowed into the combustion zone 5 only at the bottom of the column and combustion is confined to the zone to which air is supplied. The air that flows through the foraminous material 32 into the fire zone flows out through the grate 2 into the plenum chamber 34 and from the plenum chamber upwardly through a heat exchange zone which comprises sidewalls 35, back wall 36 and peripheral bottom wall 37. Each sidewall 35 is secured along its front edge to the front wall 11, and along its upper edge to the top wall 14 and it extends back beyond the backwall 31 of the means 3 where it is joined to the vertical edge of backwall 36. These walls 35 and 36 terminate at their bottom edges at the grate level. The sidewalls 35 are located between the sidewalls 10 of the stove and the sidewalls 30 of the means 3 and thereby form two chambers at each side of the stove as seen in FIG. 4. Backwall 36 likewise is located between back wall 13 of the stove and backwall 31 of means 3 to form two chambers at the back of the stove 1, as seen in FIG. 5. At their lower edges sidewalls 35 and backwall 36 are connected to the peripheral bottom wall 37 which is also connected to the bottom edges of sidewalls 30 and rear wall 31 of the means 3 to hold the column of particulate fuel which prevents the flow of air down through means 3 from the inlets or vents in door 17 and up from the plenum chamber back through the means 3. The space between walls 30 and 31 of means 3 and walls 35 and 36 of the chamber forms an air passageway to conduct air from the source, e.g., the atmosphere, into the combustion zone. The space between sidewalls 35 and sidewalls 10 and between back walls 13 and 36 constitutes the heat exchange zone through which the products of combustion pass from the plenum chamber 34.

Figure 5:
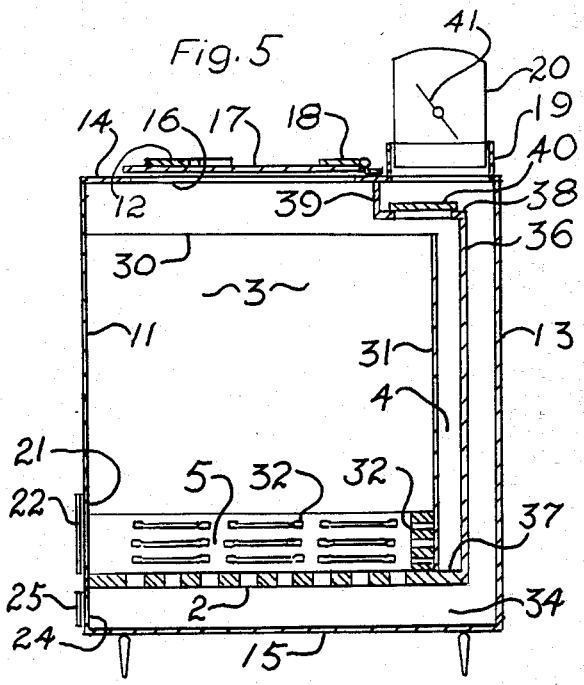
FIG. 5 is a vertical sectional view on the line 5—5 of FIG. 1.

The products of combustion which flow up through this heat exchange zone are withdrawn from the stove through the stove pipe fitting 19 and the connection thereof with the exhaust system, including a section or more of stove pipe 20 as shown in FIGS. 1 through 5. In order to provide adequate cross-sectional area for the products of combustion to leave the heat exchange zone, the back wall 36 extends only part way of the distance above the tops of the walls 30, 31 to the top wall 14, where it is joined to a horizontal section 38 and it in turn is joined to a short vertical wall 39 extending to the top wall 14, as seen in FIG. 5. A slidable damper 40 is provided for controlling air flow from the firebox upwardly to the outlet through collar 19. It is opened to start a fire on grate 2 and closed for normal operation of the apparatus. A damper 41 is provided in the stovepipe 20 for varying the cross-sectional area of the outlet from the heat exchange zone into the exhaust system as will be understood by those skilled in the art.

The combustion apparatus illustrated in FIGS. 1 through 5 is operated by starting a small fire on the grate 2 by introducing and igniting newspaper, kindling, and the like, either through door 17 in the top of the stove or through door 22 in the front of the stove with damper 40 in opoen position. After the fire is ignited, e.g., with a match, combustion air can be provided by opening damper 12 or by leaving either or both doors 17 and 22 slightly ajar. Door 25 may also be opened partially, if desired, in order to start the initial fire vigorously. When it has become a vigorous fire, sufficient fuel may be added through the opening 16 in the top of the stove to provide a bed of hot coals overlying at least a substantial portion of the bottom area of the fire zone 5. When this fire is sufficiently vigorous, fuel may be added through the loading door 17 in the top of the stove until it fills the entire means 3 and thus establishes a column of the particulate fuel material above the grate 2. By opening damper 12 and closing damper 40 and the doors 17, 22 and 25, if they have been opened, air is then forced to flow from the air supplied through damper 12 and channel 4 through the foraminous means 32 into the fire zone where it supports combustion only in the fire zone. The air thus introduced flows from the fire zone through the grate 2 into the plenum chamber 34 and from there through the heat exchange zone to the outlet formed by the stove pipe fitting 19 into the exhaust system of the stove. The force that causes air to flow in the manner described is pressure differential, i.e., there is a drop in pressure from the air inlet such as 12 to the outlet such as 30. In general, the pressure differential caused by heating the combustion air in the heating or combustion zone 5 as it flows through it before passing through the grate and plenum chamber into the heat exchange zone leading to the exhaust system provides sufficient force to cause the described air flow but this force may be supplemented, if desired, by a blower in the air supply system or an exhaust fan in the exhaust system, as those skilled in the art will understand. This operating method is very efficient because the products of combustion such as smoke and vapors from the fuel, both of which are combustble, form at the interface of the fire zone with the particulate material above it as the fuel is burned away and permits the column gradually to sink as material is consumed. These products of combustion are then carried with the flowing air downwardly from the interface where they are formed through the hot coals in the firebox where they are fully consumed and burned by the oxygen in the air to give up their entire potential heat content. The gas leaving the stove with the products of combustion is therefore primarily made up of the remaining constituents of the air supplied to the apparatus plus carbon dioxide formed in the combustion zone and these products of combustion are essentially free from tiny carbon particles that form smoke and from combustible vapors formed at the interface of the fire zone with the particulate fuel. The gas that is discharged from the exhaust system is practically colorless, odorless, and harmless, thus preventing polution of the air at the outlet of the exhaust system. By causing these hot products of combustion to flow upwardly through the heat exchange system a further efficiency is achieved by giving this hot air the opportunity to transfer practically all of its contained energy into the heat exchange zone where the hot side and back walls conduct and radiate this energy into the atmosphere surrounding the stove. In normal operation with fuel of small particle size, there is practically no air flow down through means 3 but the fuel is exposed to fresh air at its surface. If any combustion should occur at the top surface when the fuel rises to combustion temperature, the smoke and gases produced thereby flow over the top edges of walls 30 and 31, down passageway 4 and into the combustion zone 5 through passageways 32. If large pieces of fuel such as lump coal and logs are used so that resistance to air flow through means 3 is low, the walls 30 and 31 may go full height to top wall 14 and dampered air vents into passageways 4 may be provided in top wall 14 instead of dampered openings 12.

Figure 3:
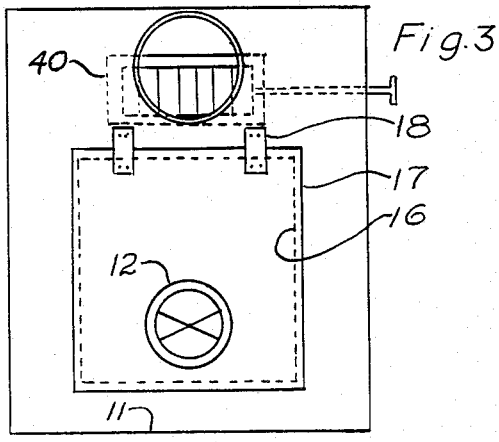
FIG. 3 is a top view of the embodiment of FIG. 1.

The rate at which fuel is oxidized in the apparatus of the invention depends upon the quantity of air flowed into the firebox in a given length of time. This rate is adjustable and can be controlled by the settings of dampers 12 and 41 in the stove top 14 and the stove pipe 20, respectively, as seen in FIG. 3 and 5.

It is also desirable that the bottom of the stove be elevated above the floor upon which the stove is supported so as to permit conduction and radiation of heat from the bottom which also forms part of the heat exchange system of the stove. This elevation is readily provided by legs 27 adjacent to the four corners of the rectangular stove. If a circular stove is used, a minimum of three legs will provide adequate support for the stove to space it above the floor on which it rests.

The embodiment of the invention illustrated in FIGS. 6 through 11 has many parts comparable to the parts of the embodiment shown in FIGS. 1 through 5. These comparable parts have been given the same reference numerals as the parts in the embodiment of FIGS. 1 through 5 with a subscript a and these parts require no further description. The embodiment of FIGS. 6 through 11 differs from the embodiment of FIGS. 1 through 5 in the following respects:

(A) It includes an oven 50.

(B) The means for introducing air into the combustion zone adjacent to and above the grate **2*a* is formed by bending the lower edge of the walls 30*a* and 35*a* inwardly to form a vertical slit 32*a*** through which the air enters from the air introduction means.

(C) The combustion device is designed to be located on the floor of a fireplace cavity with the rear part of the apparatus within the cavity and the front part extending outwardly beyond it. The extended part may serve as a cooking surface.

Referring now to FIGS. 6 through 11, the oven 50 comprises sidewalls 51, a back wall 52, a top wall 53, and a bottom wall 54. The left sidewall 51, as seen in FIG. 9, is spaced from the right wall **35*a* sufficiently far to provide a heat exchange zone 55 between them. Left wall 35*a* is spaced from left wall 10*a* sufficiently far to provide a heat exchange zone 55*a* between them. The right sidewall 51 is spaced from sidewall 10*a* a sufficient distance to form a heat exchange zone 56 between them. The top wall 53 is spaced from the top wall 14*a* of the stove a sufficient distance to form a heat exchange zone 57 between them. Bottom wall 54 is spaced from bottom wall 15*a* a sufficient distance to form a heat exchange zone 58 between them. Similarly, the back wall 52 is spaced from the back wall 13*a* a sufficient distance to form a heat exchange zone 57 between them. The front edges of the sidewalls 51, top wall 53 and bottom wall 54 are secured to the periphery of an opening 59 in the front wall 11*a* of the stove and a hinged door 60 is provided to open and close opening 59 as desired in normal operation of the unit. A damper 63 at the top of sidewall 35***a* serves the same function as damper 40 in the embodiment of FIGS. 3, 4 and 5.

Figure 10A:
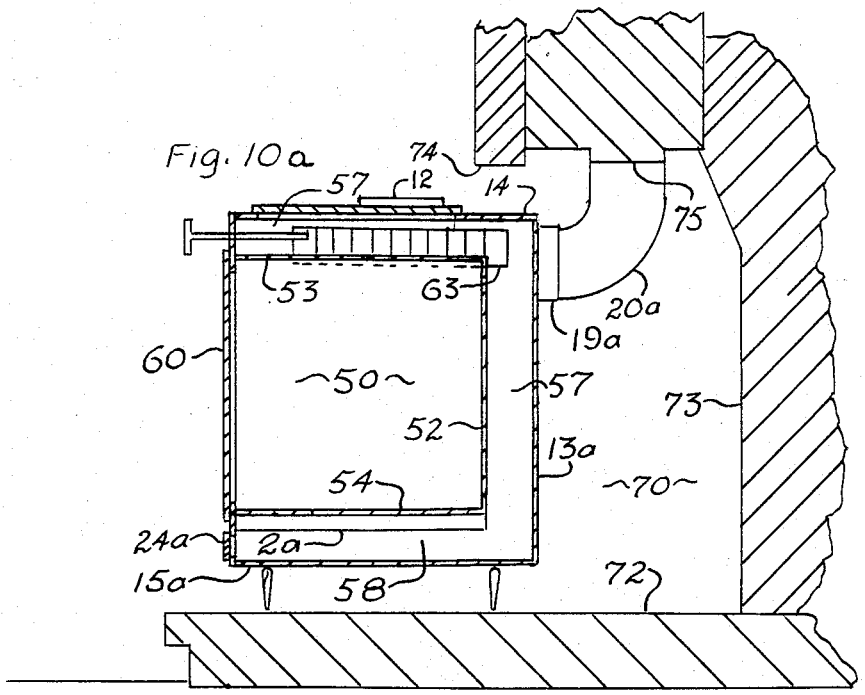
FIG. 10*a* is a vertical sectional view similar to FIG. 10 showing the unit associated with a fireplace cavity.
Figure 11:
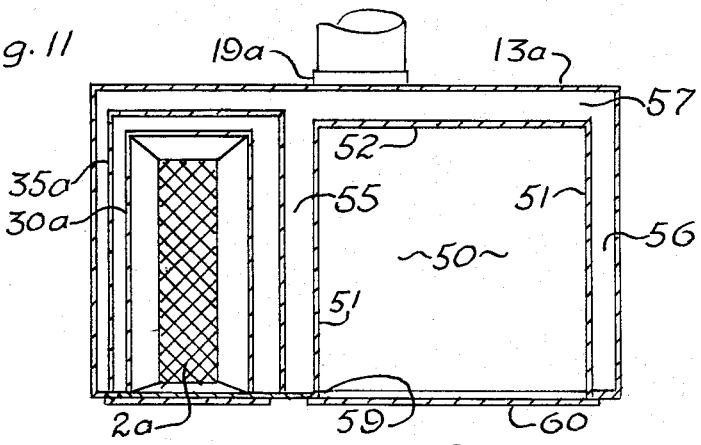
FIG. 11 is a horizontal sectional view along the line 11—11 of FIG. 7.

In the embodiment of FIGS. 6 through 11, the stove pipe fitting 19*a* is preferably located in the upper part of the back wall 13*a*, as shown in FIGS. 10 and 11.

The embodiment of FIGS. 6 through 11 may be placed partially, i.e., the back portion, in a fireplace cavity 70 as shown in FIGS. 9 and 10 with the stove pipe 20*a* connecting the stove pipe fitting 19*a* with the chimney of the fireplace.

The fireplace cavity 70 is provided with sidewalls 71, a floor 72, a back wall 73, a top wall 74 and a chimney 75 which extends from the fireplace cavity 70 to the roof of the dwelling, in the normal manner.

The combustion apparatus illustrated in FIGS. 6 through 11 operates in essentially the same manner already described in the embodiment of FIGS. 1 through 5. To assist in starting the fire, starting damper 63 may be opened so that when the combustible material put on the grate to start the fire is ignited, the unit operates on the up-draft principle with the products of combustion leaving the unit through the opening which is normally closed by damper 63 and from there into the stove pipe 20*a*. As soon as the fire has developed a sufficient bed of coals, damper 63 is closed and the unit then operates on the down-draft principle with the products of combustion leaving the bed of coals through grate 2*a* and they pass upwardly through the heat exchange zones 55, 55*a*, 56, 57 and 58, where they give up heat to the oven 50 and air surrounding the apparatus. Oven 50 can be used for baking and other purposes, in a manner well understood by those skilled in the art.

Where the combustion apparatus is used in a fireplace cavity, it is desirable to provide means for making the combustion zone visible from the front of the unit and this may be accomplished by making the door 22*a* of fire resistant glass. The ash door 24*a* and the top load fuel door 17*a*, as well as the oven door 60, may also be made of or provided, in part, with glass, if desired.

Figure 12:
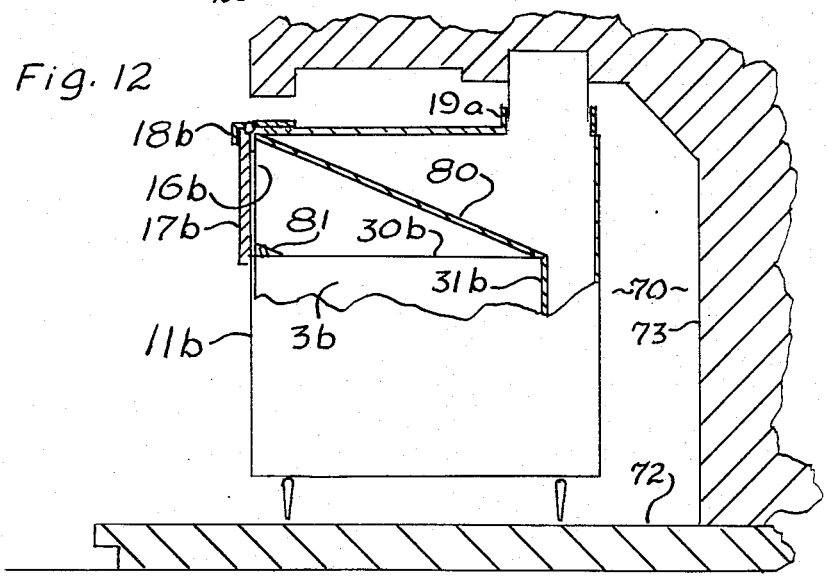
FIG. 12 is a side view with the upper portion broken away too provide a fragmentary vertical sectional view of the upper part of a further embodiment of the invention showing means for top loading a combustion apparatus of the invention such as disclosed in the previous figures from the front instead of the top when the combustion apparatus is located inside a fireplace cavity.

The combustion apparatus of FIGS. 1 through 5 and of FIGS. 6 through 11 may be readily adapted to be placed completely within a fireplace cavity by the means shown in FIG. 12. In this embodiment, the parts which are comparable in function to parts in the previously described embodiments have the same reference characters with a postscript b. The principal difference in this embodiment is that the fuel supply opening is placed in the front wall 10*b* rather than the top wall. Referring to FIG. 12, the front wall 1*b* is provided with a fuel supply opening 16*b* adjacent to the top thereof and this opening is normally closed by door 17*b* hinged at 18*b* to the front wall 11*b*, optionally with gasket material (not shown) between the peripheries of the opening 16*b* and the door 17*b* to make the same airtight, if desired. A wall 80 is provided extending from the upper edge of the opening 16*b* to the upper edge of the rear wall 31*b*. A short wall 81 may be provided from the lower edge of opening 16*b* to the upper edge of the wall 30*b* of the means 3*b* for holding a column of particulate fuel. When the fuel is introduced through the opening 16*b* when the door 17*b* is open, it fills the means 3*b* in the same manner already described in connection with the embodiment in FIGS. 1 through 5.

The term "particulate fuel" is used herein to define generically all types of combustible material such as sawdust, wood chips and shavings, powdered coal, coal briquettes, lump coal and chunks of wood, including cord wood and logs of any size small enough to pass through the fuel door of the apparatus and to descend in the means 3 as fuel below it is consumed in the fire box.

The apparatus of the invention has been described in relation to three specific embodiments, but it will be recognized by those skilled in the art that further variations and modifications may be made without departing from the principle of the invention as herein described, illustrated and claimed.

Having thus described and illustrated the invention, what is claimed is:

1. A combustion method which comprises establishing within a chamber having front, back and side walls a column of particulate fuel above a grate, establishing a burning zone at the lower end of the column of fuel in a zone adjacent to and above said grate, said column being surrounded by impervious and non-combustible walls above said burning zone which are spaced inwardly from said side and back walls of said chamber to provide a vertical air passageway, supplying all the combustion air downwardly through said vertical passageway and then only laterally into the burning zone over a substantial height thereof, withdrawing products of combustion downwardly through said combustion zone and said grate directly into a reduced pressure plenum chamber and from said plenum chamber upwardly through a heat exchange zone adjacent to said passageway by air pressure differential without passing upwardly through said column of particulate fuel.

2. The combustion method as set forth in claim 1 in which air is supplied to the burning zone laterally from the periphery of said zone.

3. The method as set forth in claim 2 in which the air is supplied laterally into the burning zone in small streams.

4. The combustion method as set forth in claim 2 in which the air is supplied laterally into the burning zone through an elongated slit.

5. A combustion apparatus which comprises:

(a) a chamber having front, top, bottom, back and side walls;

(b) a grate mounted within said chamber above said bottom wall to form a plenum chamber between them;

(c) fuel holding means comprising impervious and non-combustible side walls engaging said front wall and spaced from the side and back walls of said chamber to form a vertical air passageway between the side and back walls of the fuel holding means and the side and back walls of said chamber for holding a column of particulate fuel above said grate;

(d) means for flowing all the combustion air into said fuel holding means by air pressure differential downwardly through said air passageway and only laterally at the bottom thereof to establish a combustion zone above said grate and at the bottom only of said column of particulate fuel;

(e) means to withdraw products of combustion from said combustion zone only downwardly through said zone and through said grate directly into said plenum chamber by pressure differential;

(f) a heat exchange zone next to said air passageway having upper and lower ends communicating at its lower end with said plenum chamber and at its upper end with exhaust; and (g) means for exhausting the withdrawn products of combustion upwardly through said heat exchange zone by pressure differential without passing upwardly through said fuel holding means.

6. A combustion apparatus as set forth in claim 5 in which the apparatus is a freestanding stove having front, back, side, top and bottom walls of heat conducting material, a fuel supply opening in a wall of said stove, a hinged door normally closing said fuel supply opening, said means for holding said column of particulate fuel comprising side and back walls spaced inwardly from the back and side walls of said stove, and means at the bottom of at least one of said inwardly spaced walls for supplying air to the combustion zone at the bottom of said column of particulate fuel laterally from the periphery.

7. A combustion apparatus as set forth in claim 6 in which the fuel supply opening is in the top wall of the stove.

8. A combustion apparatus as set forth in claim 6 in which the fuel supply opening is in the front wall of the stove.

9. A combustion apparatus as set forth in claim 6 in which the side and back walls of the stove are exposed in operation to products of combustion in a heat exchange zone.

10. A combustion apparatus as set forth in claim 6 which includes an oven exposed on the outside surfaces of its side, back, top and bottom walls to products of combustion in a heat exchange zone.

11. A fuel combustion apparatus comprising front, top, bottom, side and back walls of heat conducting and radiating material, a grate mounted in said apparatus spaced upwardly from said bottom wall to form a plenum chamber between the grate and bottom wall, fuel holding means extending upwardly from said grate comprising spaced side walls engaging the front wall of said apparatus and a rear wall, said side and rear walls having orifices at their lowers ends to supply air to a combustion zone above said grate and being spaced from the top, side and back walls of said chamber forming an air passageway communicating at its upper end with an air supply source and at its lower end with said orifices; an exhaust passageway between the rear wall of said fuel holding means and the back wall of said apparatus communicating at its lower end with said plenum chamger and at its upper end with exhaust; a hinged door normally covering an opening in the top wall of said apparatus for admitting fuel into said fuel holding means and air into the upper end of said air passageway; and a damper controlled opening in the upper portion of the wall between the air passageway and the exhaust passageway for permitting, when open, products of combustion to flow directly to exhaust during the starting of a fire in the combustion zone but preventing such flow when closed and a column of fuel is present in the fuel holding means above a bed of burning embers on said grate.

* * * * *